US010072459B2

(12) United States Patent
Bowen et al.

(10) Patent No.: US 10,072,459 B2
(45) Date of Patent: Sep. 11, 2018

(54) CORD RETENTION ASSEMBLY FOR A COVERING

(71) Applicant: Hunter Douglas, Inc., Pearl River, NY (US)

(72) Inventors: Jesse Bradley Bowen, Belmont, NC (US); Tonya Lee Parker, Oldtown, MD (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 15/433,265

(22) Filed: Feb. 15, 2017

(65) Prior Publication Data

US 2018/0230743 A1 Aug. 16, 2018

(51) Int. Cl.

| | |
|---|---|
| ***E06B 9/384*** | (2006.01) |
| ***E06B 9/326*** | (2006.01) |
| ***E06B 9/327*** | (2006.01) |

(52) U.S. Cl.

CPC ..... *E06B 9/384* (2013.01); *E06B 9/326* (2013.01); *E06B 9/327* (2013.01)

(58) Field of Classification Search

CPC .. E06B 2009/2622; E06B 9/326; E06B 9/382; E06B 9/384; E06B 9/327

USPC ... 24/DIG. 28, DIG. 10, 567, 566, 270, 619, 24/131 C, 129 C, 910, 455, 485, 499, 24/530, 598.2

See application file for complete search history.

(56) References Cited

U.S. PATENT DOCUMENTS

| | | | | |
|---|---|---|---|---|
| 646,366 A | | 3/1900 | Durst | |
| 2,090,962 A | * | 8/1937 | Peters | A45F 5/02 70/456 R |
| 2,625,976 A | * | 1/1953 | Reynolds | B60C 27/10 152/242 |
| 2,823,537 A | * | 2/1958 | Segal | A44B 15/00 24/600.6 |
| 3,890,800 A | * | 6/1975 | Montague | A44C 7/00 24/598.2 |
| 4,370,783 A | * | 2/1983 | Fretwell, Jr. | B60D 1/18 24/115 F |

(Continued)

FOREIGN PATENT DOCUMENTS

| | | |
|---|---|---|
| CN | 201658216 | 12/2010 |
| DE | 202014106109 | 4/2015 |

OTHER PUBLICATIONS

Smart Home Products "Split Rings 37mm White pk10." Dated Feb. 8, 2017 (2 pages).

(Continued)

*Primary Examiner* — Blair M Johnson
(74) *Attorney, Agent, or Firm* — Dority & Manning, P.A.

(57) ABSTRACT

In one aspect, a cord retention assembly for a covering for an architectural structure may include a cord guide coupled to a shade panel of the covering that is configured to receive a corresponding cord of the covering. The cord guide may form a closed shape and may also be configured to define an entryway around at least a portion of a perimeter of the closed shape. In addition, the cord retention assembly may include at least one retention member installed relative to the cord guide such that the retention member(s) prevents the entryway of the cord guide from being rotated past the attachment location defined between the shade panel and the cord guide.

27 Claims, 5 Drawing Sheets

(56) References Cited

U.S. PATENT DOCUMENTS

| | | | | |
|---|---|---|---|---|
| 5,615,454 | A * | 4/1997 | Contarino | A45C 13/20 24/116 A |
| 5,722,277 | A * | 3/1998 | Williams | A44B 15/007 70/456 R |
| 6,843,086 | B2 * | 1/2005 | Fitch | A44B 15/005 24/3.6 |
| 8,381,792 | B2 | 2/2013 | Perkowitz | |
| 8,474,507 | B2 | 7/2013 | Anthony et al. | |
| 8,813,807 | B1 | 8/2014 | Leblanc | |
| 2012/0305199 | A1 | 12/2012 | Lin | |

OTHER PUBLICATIONS

Safe-T-Shade "Ring Lock" Dated Feb. 8, 2017 (3 pages).
guide.alibaba.com Taobao Market Place "Roman Blind Cord Repair Rings." Dated Feb. 8, 2017 (4 pages).

* cited by examiner

CORD RETENTION ASSEMBLY FOR A COVERING

FIELD OF THE INVENTION

The present subject matter relates generally to coverings for architectural structures and, more particularly, to a cord retention assembly for a covering.

BACKGROUND OF THE INVENTION

Retractable coverings for architectural structures, such as windows, doors, archways and the like, have become commonplace and assume numerous variations for both functional and aesthetic purposes. In many instances, such retractable coverings typically include a headrail and some form of shade material or panel extending from the headrail. The shade panel is movable relative to the headrail between extended and retracted positions. Systems for operating such retractable coverings can assume various forms, such as one or more lift cords that extend vertically relative to the shade panel.

To retain the lift cords relative to the shade panel, it is known to utilize cord guides spaced apart vertically along the shade panel through which the lift cords are received. For instance, for woven wood coverings, split rings have been used as cord guides for the lift cords, with each split ring being threaded onto a warp yarn(s) of the woven wood panel to couple the split-ring to the panel. Unfortunately, due to their configuration, the split-rings often become unintentionally decoupled from the shade panel. For example, unintended rotation of the split-ring may result in the split-ring unthreading itself from the warp yarn(s) of the woven wood panel. Such decoupling of the lift cord from the shade panel can negatively impact the operation of the covering and can also inhibit proper functioning of the associated cord shroud. For instance, decoupling of the lift cord from the shade panel may allow the lift cord to be pulled away from the cord shroud and formed into a significantly large loop, which can present a safety issue.

Accordingly, an improved cord retention assembly for use with a covering for an architectural structure would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a cord retention assembly for a covering for an architectural structure. In several embodiments, the cord retention assembly may include a cord guide coupled to a shade panel of the covering that is configured to receive a corresponding cord of the covering. The cord guide may form a closed shape and may also be configured to define an entryway around at least a portion of a perimeter of the closed shape. In addition, the cord retention assembly may include at least one retention member installed relative to the cord guide such that the retention member(s) prevents the entryway of the cord guide from being moved past the attachment location defined between the shade panel and the cord guide in a manner that would allow the cord guide to become decoupled from the shade panel.

These and other features, aspects and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
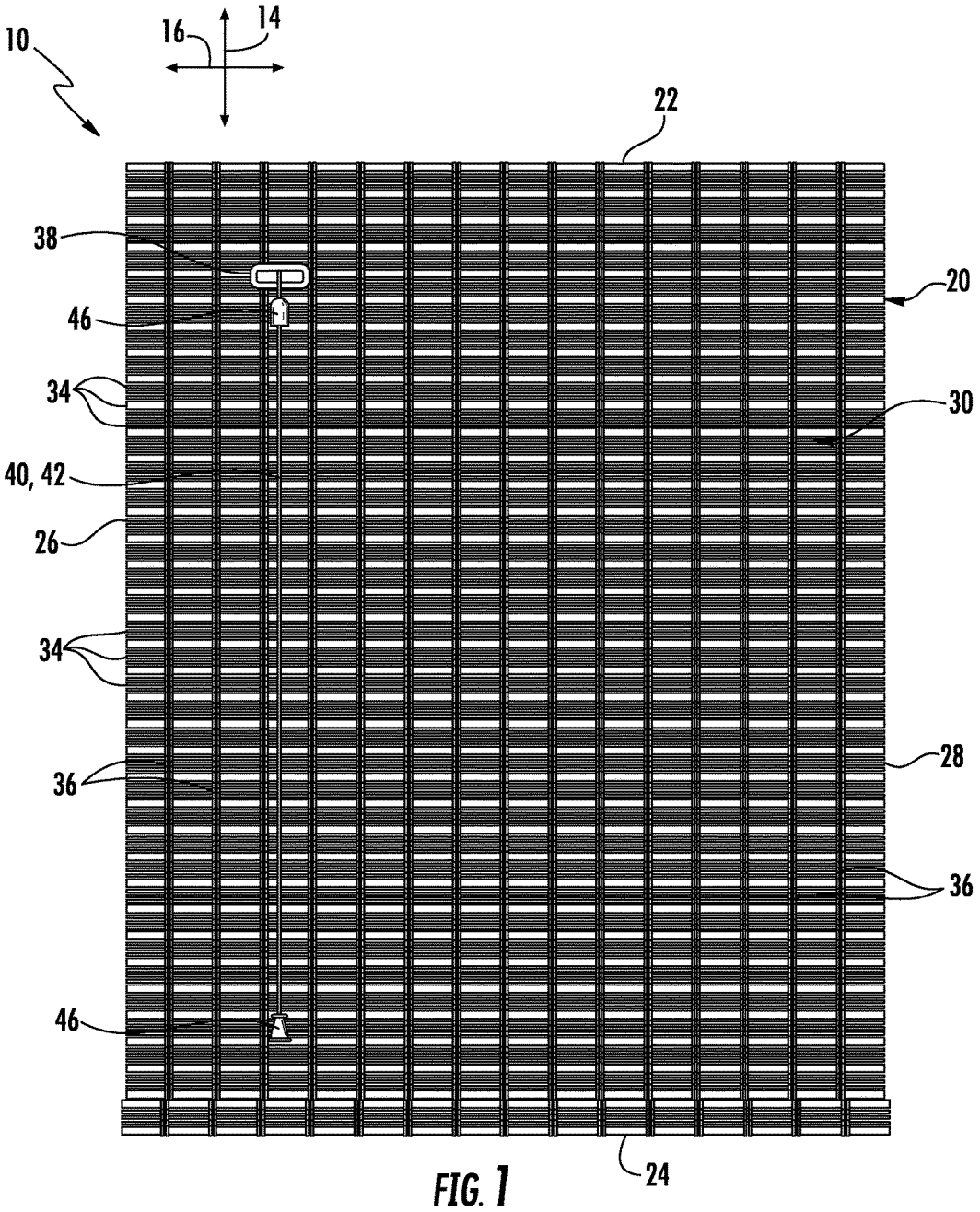
FIG. 1 illustrates a front view of one embodiment of a covering in accordance with aspects of the present subject matter.

In general, the present subject matter is directed to a cord retention assembly for a covering for an architectural feature or structure (referred to herein simply as an architectural "structure" for the sake of convenience and without intent to limit). Specifically, in several embodiments, the covering may include a shade panel and one or more cord retention assemblies positioned at or adjacent to the rear face of the shade panel. In general, each cord retention assembly may be configured to retain a lift cord(s) and/or an associated cord shroud(s) of the covering relative to the shade panel.

In one embodiment, the disclosed cord retention assembly may include a cord guide coupled to the shade panel at an attachment location and at least one retention member installed relative to the cord guide at or adjacent to the attachment location. The retention member(s) may generally be configured to be installed relative to the cord guide so as to prevent the cord guide from becoming unintentionally decoupled from the shade panel.

In one embodiment, the cord guide may define a closed shape for receiving a cord(s) of the covering (e.g., a lift cord(s) and/or one or more cords of an associated cord shroud(s)). In addition, the cord guide may include an access location or entryway provided along at least a portion of the outer perimeter of the closed shape for receiving the cord(s) and/or any other suitable component(s) of the covering (e.g., a covering component(s), such as a fiber or yarn, that facilitates coupling the cord guide to the shade panel). In general, the entryway may be defined by any suitable structure and/or may have any suitable configuration that allows a component(s) of the covering to be received within the closed shape by passing or inserting the component(s) through the entryway.

In one embodiment, the entryway may correspond to a split overlapped portion of the cord guide along which a section of the cord guide overlaps itself around the perimeter of the closed shape. For instance, in a particular embodiment, the cord guide may correspond to a split-ring. In such an embodiment, the cord guide may, for example, be formed from a wire that has been coiled into a closed, circular shape such that the wire overlaps itself around at least a portion of the closed circular shape.

In one embodiment, the cord guide may be configured to be coupled to one or more fiber(s) or other longitudinally extending components of the shade panel. For instance, the fiber(s) may be passed through the entryway of the cord guide to allow the cord guide to be coupled to the shade panel at a corresponding attachment location. In such an embodiment, the retention member(s) may be configured to prevent the cord guide from being rotated past the attachment location in a manner that would allow the cord guide to decouple itself from the fiber(s). As used herein, the term "fiber" should be construed broadly and may include, but is not limited to, any thread or filament or any combination of threads or filaments.

In one embodiment, the shade panel may be configured as a woven wood panel. For instance, the shade panel may include a plurality of strips of natural material woven together via a plurality of longitudinally extending yarns (e.g., warp yarns). In such an embodiment, the cord guide may be configured to be coupled to one or more of the yarns of the woven wood panel, such as by inserting or passing a yarn(s) through the entryway of the cord guide.

In one embodiment, the retention member(s) may correspond to a pair of spacers (e.g., a first spacer and a second spacer) configured to be installed on the cord guide relative to its corresponding attachment location on the shade panel. For instance, the spacers may be installed on the cord guide along opposed sides of the attachment location relative to the entryway of the cord guide. In such an embodiment, when the cord guide is rotated relative to the shade panel in a first direction, a first portion of the cord guide may contact the first spacer to prevent the entryway from being rotated past the attachment location in the first direction. Similarly, when the cord guide is rotated relative to the shade panel in an opposed second direction, a second portion of the cord guide may contact the second spacer to prevent the entryway from being rotated past the attachment location in the second direction.

In one embodiment, each spacer may define an opening configured to receive a wire or other portion of the cord guide. In such an embodiment, the opening may be dimensionally smaller than a corresponding dimension of an enlarged portion of the cord guide disposed at or adjacent to the entryway to prevent such enlarged portion from being received within the opening. As such, when the enlarged portion contacts the spacer, the spacer may function as a rotational stop for the cord guide.

Additionally, in another embodiment, the retention member(s) may correspond to an elastic band configured to be installed on the cord guide relative to the attachment location. For instance, the elastic band may be installed on the cord guide such that a central portion of the elastic band extends across the attachment location and opposed first and second side portions of the elastic band are positioned along opposed sides of the attachment location. In such an embodiment, when the cord guide is rotated relative to the shade panel in a first direction, a first portion of the cord guide may contact the first side portion of the elastic band to prevent the entryway from being rotated past the attachment location in the first direction. Similarly, when the cord guide is rotated relative to the shade panel in an opposed second direction, a second portion of the cord guide may contact the second side portion of the elastic band to prevent the entryway from being rotated past the attachment location in the second direction.

Figure 2:
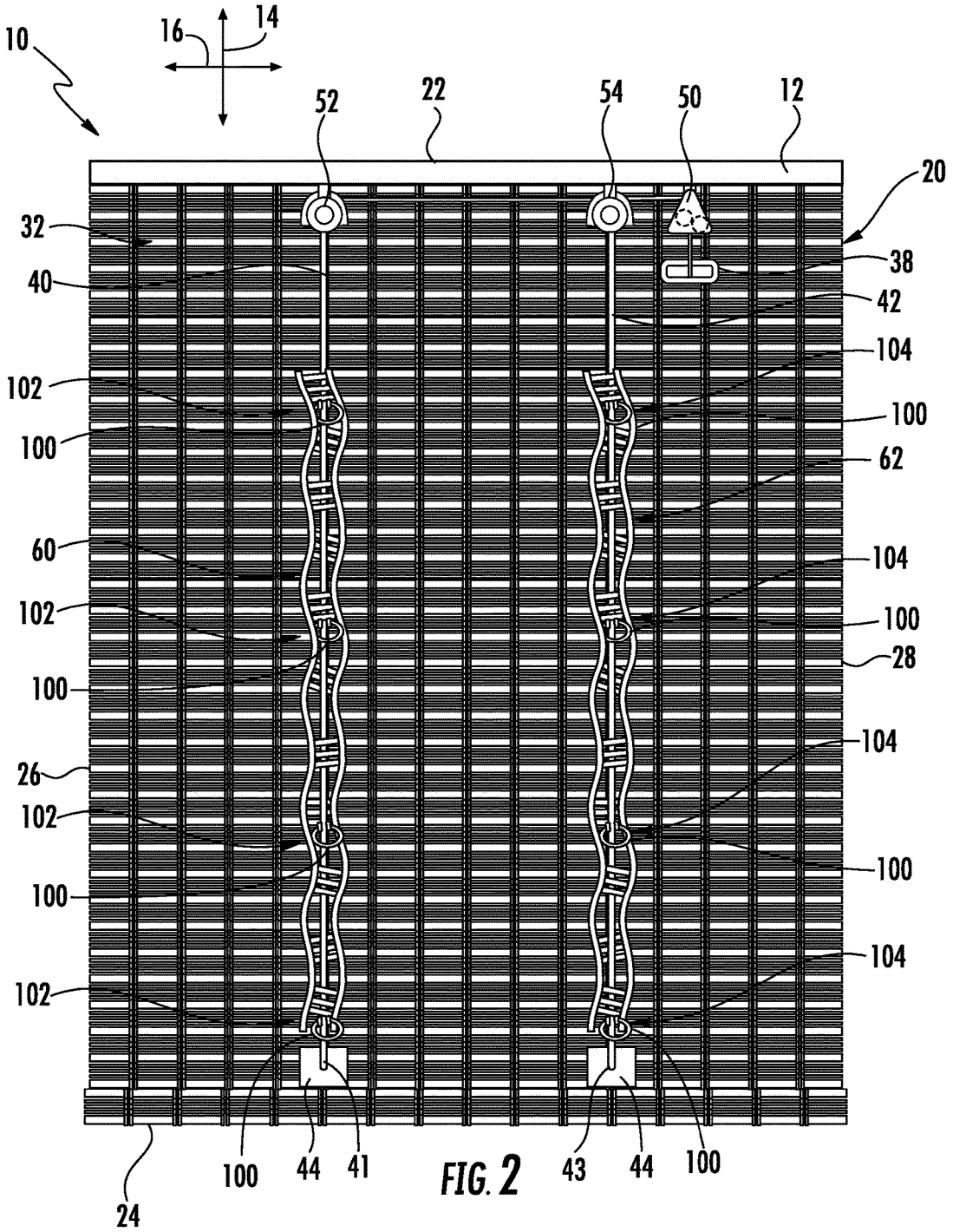
FIG. 2 illustrates a rear view of the covering shown in FIG. 1, particularly illustrating a plurality of cord retention assemblies coupled to a shade panel of the covering to allow the cord retention assemblies to be provided in operative association with corresponding lift cords of the covering.

Referring now to the drawings, FIGS. 1 and 2 illustrate respective front and rear views of one illustrative embodiment of a covering 10 for an architectural structure in accordance with aspects of the present subject matter. In general, the covering 10 may be configured to be installed relative to a window, door, or any other suitable architectural structure as may be desired. In one embodiment, the covering 10 may be placed in operative association with a head rail 12 (FIG. 2) or other suitable support structure that is configured to be mounted relative to an architectural structure to allow the covering 10 to be suspended or supported relative to the architectural structure. It should be understood that the covering 10 is not limited in its particular use as a window or door shade, and may be used in any application as a covering, partition, shade, and/or the like, relative to and/or within any type of architectural structure.

As shown in the illustrated embodiment, the covering 10 may include a shade panel 20 configured to be moved between an extended position (e.g., as shown in FIGS. 1 and 2) and a retracted position (not shown). When lowered from the retracted portion to the extended position, the shade panel 20 may be configured to cover the adjacent architectural structure. Similarly, when raised from the extended position to the retracted position, the shade panel 20 may be configured to expose the adjacent architectural structure. It should be appreciated that the shade panel 20 may also be configured to be moved to any suitable intermediate position defined between the extended and retracted positions to allow the adjacent architectural structure to be only partially covered or exposed.

In the illustrated embodiment, when the shade panel 20 is moved to the extended position, the panel 20 may be configured to extend in a heightwise or vertical direction (indicated by arrow 14 shown in FIGS. 1 and 2) between a top end 22 (FIG. 1) and a bottom end 24 and in a horizontal or lateral direction (indicated by arrow 16 shown in FIGS. 1 and 2) between a first lateral end 26 and a second lateral end 28. Additionally, the shade panel 20 may also be configured to define both a front face 30 (FIG. 1) and a rear face 32 (FIG. 2) of the covering 10, with the front and rear faces 30, 32 extending vertically between the top and bottom ends 22, 24 of the shade panel 20 and laterally between the first and second lateral ends 26, 28 of the shade panel 20.

It should be appreciated that the terms "front" and rear" are generally used herein simply to distinguish opposite sides or faces of the shade panel 20, itself, and/or opposite sides or faces of other components or features of the covering 10. Thus, one of ordinary skill in the art should readily appreciate that the front face 30 of the shade panel 20 may correspond to either the side of the panel 20 designed to face towards the interior of the room within which the covering 10 is installed or the side of the panel 20 designed to face away from the interior of such room. However, for purposes of non-limiting description, the front face 30 will be described herein as the side of the shade panel 20 facing towards the interior of the room within which the covering 10 is installed, with the rear face 32 of the shade panel 20 facing towards the adjacent architectural structure.

As shown in FIGS. 1 and 2, in several embodiments, the shade panel 20 may correspond to a woven wood panel. In such an embodiment, as particularly shown in FIG. 1, the shade panel 20 may include a plurality of laterally extending strips of material 34 woven or coupled together by a plurality vertically extending yarns 36 (e.g., warp yarns). For example, as shown in the illustrated embodiment, the vertically extending yarns 36 may be woven between the strips of material 34 at various locations spaced apart laterally between the first and second lateral ends 26, 28 of the shade panel 20. As is generally understood, the strips of material 34 may be formed from a natural material, such as natural wood, grasses, bamboo, jute, reeds, and/or any combination thereof and may be coupled together using a tight or loose weave. Alternatively, the shade panel 20 may be formed from any other suitable material. For instance, the shade panel 20 may correspond to a textile-based panel formed by the interlacing of fibers, such as yarns, multi-filament fibers, monofilament fibers and/or any combination thereof.

The covering 10 may also include one or more lift cords and various associated lift or drive assembly components for raising and lowering the shade panel 20 between its extended and retracted positions. For instance, in the illustrated embodiment, the covering 10 includes a pair of lift cords (e.g., a first lift cord 40 and a second lift cord 42) for raising and lowering the shade panel 20. As particularly shown in FIG. 2, in one embodiment, the first lift cord 40 may be configured to pass through a cord lock assembly 50 supported by the headrail 12 and may extend laterally across the rear face 32 of the shade panel 20 to a first pulley 52 coupled to the headrail 12. The first lift cord 40 may then extend vertically from the first pulley 52 along the rear face 32 of the shade panel 20 towards the bottom end 24 of the panel 20, with the first lift cord 40 being passed through and/or received within a plurality of vertically aligned cord retention assemblies 100 coupled to the shade panel 20 at various spaced apart, first attachment locations 102 defined between the top and bottom ends 22, 24 of the shade panel 20. In one embodiment, the first lift cord 40 may be coupled to a portion of the shade panel 20 at or adjacent to its bottom end 41, such as by coupling the bottom end 41 of the first lift cord 40 directly to the shade panel 20 or by coupling the bottom end 41 of the first lift cord 40 to a cord stop 44 configured to engage the cord retention assembly 100 positioned at the lowermost first attachment location 102. Alternatively, the bottom end 41 of the first lift cord 40 may be configured to be coupled to a bottom rail (not shown) supported at the bottom end 24 of the shade panel 20.

Similarly, as shown in FIG. 2, the second lift cord 42 may be configured to pass through the cord lock assembly 50 and may extend laterally across the rear face 32 of the shade panel 20 to a second pulley 54 supported by the headrail 12 at a location spaced apart laterally from the first pulley 52. The second lift cord 42 may then extend vertically from the second pulley 54 along the rear face 32 of the shade panel 20 towards the bottom end 24 of the panel 20, with the second lift cord 42 being passed through and/or received within a plurality of vertically aligned cord retention assemblies 100 coupled to the shade panel 20 at various spaced apart, second attachment locations 104 defined between the top and bottom ends 22, 24 of the shade panel 20. In one embodiment, the second lift cord 42 may be coupled to a portion of the shade panel 20 at or adjacent to its bottom end 43, such as by coupling the bottom end 43 of the second lift cord 42 directly to the shade panel 20 or by coupling the bottom end 43 of the second lift cord 42 to a cord stop 44 configured to engage the cord retention assembly 100 positioned at the lowermost second attachment location 104. Alternatively, the bottom end 43 of the second lift cord 42 may be configured to be coupled to a bottom rail (not shown) supported at the bottom end 24 of the shade panel 20.

Additionally, the first and second lift cords 40, 42 may also be configured to extend from the cord lock assembly 50 to a location at or adjacent to the front face 30 of the shade panel 20. For instance, as shown in FIG. 2, in one embodiment, the lift cords 40, 42 may be configured to extend from the cord lock assembly 50 through a cord opening 38 defined in the shade panel 20 at or adjacent to its top end 22. In such an embodiment, each lift cord 40, 42 may be configured to extend through the cord opening 38 and hang vertically from the opening 38 along the front face 30 of shade panel 20 to allow a user to manipulate the lift cords 40, 42 from the front-facing side of the covering 10. Additionally, as shown in FIG. 1, a tassel 46 may be coupled to one or more of the lift cords 40, 42 along the front face 30 of shade panel 20.

It should be appreciated that, in other embodiments, any other suitable arrangement may be used to locate the lift cords 40, 42 at or adjacent to the front face 30 of the shade panel 20. For instance, as an alternative to the cord opening 38, the lift cords 40, 42 may be configured to simply hang adjacent to one side of the shade panel 20 (e.g., at or adjacent to the first lateral end 26 of the shade panel 20) to allow the user to manipulate the lift cords 40, 42 from the front side of the covering 10.

Additionally, in several embodiments, the covering 10 may also include one or more cord shrouds provided in operative association with each lift cord 40, 42. As is generally understood, each cord shroud may be coupled to the shade panel 20 to provide a structure for confining or retaining the associated lift cord(s) relative to the shade panel 20. For instance, in one embodiment, the cord shroud(s) may be coupled to the shade panel 20 (e.g., via the cord retention assemblies 100) at spaced apart locations to prevent the associated lift cord(s) from being extended or pulled outwardly in a manner that would allow the lift cord(s) to be formed into a loop of a given size (e.g., as defined by relevant safety regulations). In this regard, when the cord shroud(s) is configured to be coupled to the shade panel 20 at the various attachment locations 102, 104, the vertical spacing of the attachment locations 102, 104 may, for example, be selected in a manner that limits the size of the loop that can be formed by each lift cord 40, 42 between adjacent pairs of attachment locations 102, 104.

It should be appreciated that, in general, the cord shroud(s) utilized in connection with disclosed covering 10 may have any suitable configuration that allows the cord shroud(s) to function as described herein. For instance, as will be described below, in one embodiment, the cord shroud(s) may be configured as a safety or cord ladder. In other embodiments, the cord shroud(s) may have any other suitable configuration, such as by configuring the cord shroud(s) to include a primary cord and a plurality of flexible loops spaced apart along the primary cord for receiving the lift cord(s), or by configuring the cord shroud(s) as a flexible tape or ribbon including spaced apart apertures defined therein for receiving the lift cord(s), or by configuring the cord shroud(s) as a sheath or sleeve configured to receive the lift cord(s) (e.g., a woven sheath). Examples of various suitable cord shroud configurations are disclosed in U.S. Pat. No. 8,474,507, issued on Jul. 2, 2013 and entitled "System for Confining Lift Cords in Coverings for Architectural Openings," the disclosure of which is hereby incorporated by reference herein in its entirety for all purposes.

As shown in FIG. 2, in one embodiment, the cord shrouds 60, 62 of the disclosed covering 10 may correspond to first and second safety or cord ladders provided in operative association with the first and second lift cords 40, 42, respectively. As is indicated above, each cord shroud 60, 62 may function to prevent unintended extension of its associated lift cord 40, 42 (e.g., in a manner that would allow the lift cords 40, 42 to be formed into a loop of a given size). In the illustrated embodiment, each cord shroud 60, 62 includes a pair of elongated runs or primary cords 64 (FIG. 3) extending lengthwise generally parallel to each other and a plurality of groups of rungs or cross-wise cords 66 (FIG. 3) extending between the primary cords 64, with the groups of cross-wise cords 66 being spaced apart from one another along the length of the side runs 64. In such an embodiment, each lift cord 40, 42 may be woven between the primary cords 64 of the corresponding cord shroud 62, 64 across each gap or space defined between adjacent groups of cross-wise cords 66 along the vertical distance defined between adjacent cord retention assemblies 100, thereby coupling each lift cord 40, 42 to its associated cord shroud 60, 62. Additionally, as indicated above, in one embodiment, the first and second cord shrouds 60, 62 may be coupled to the shade panel 20 at the associated first and second attachment locations 102, 104, respectively, via the cord retention assemblies 100, thereby allowing the lift cords 40, 42 to be confined between the cord retention assemblies 100 so as to prevent the lift cord 40, 42 from being formed into a loop of a given size.

Figure 3:
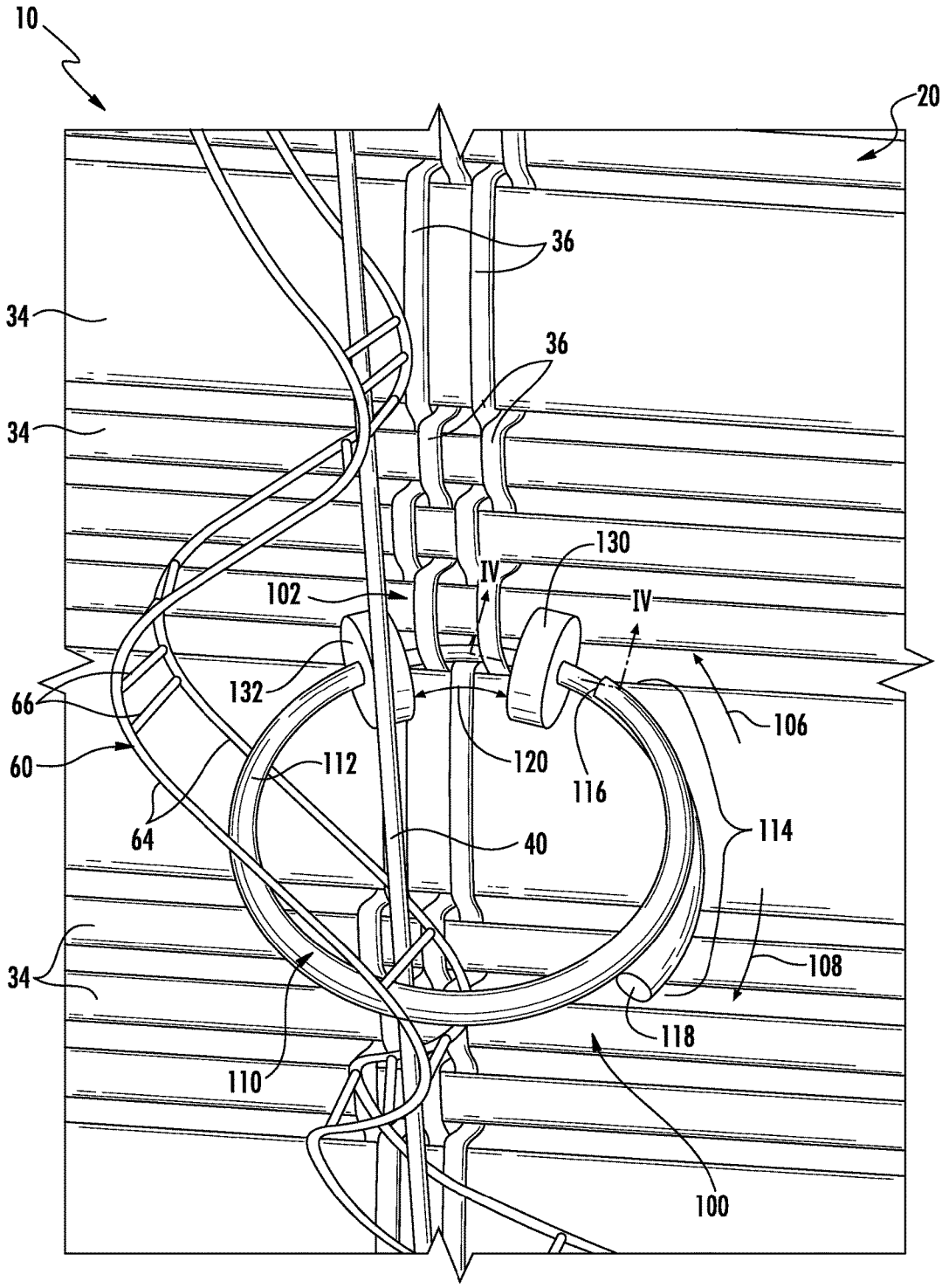
FIG. 3 illustrates an enlarged, perspective view of a portion of the covering shown in FIG. 2, particularly illustrating one embodiment of a cord retention assembly in accordance with aspects of the present subject matter.
Figure 4:
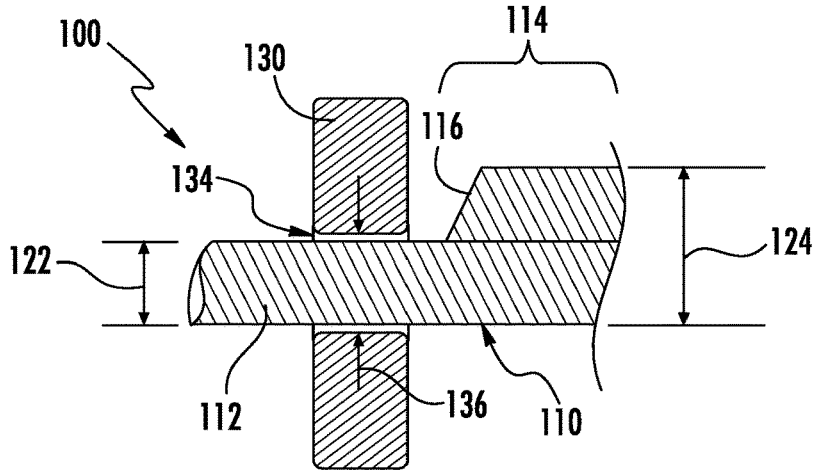
FIG. 4 illustrates a cross-sectional view of a portion of the cord retention assembly shown in FIG. 3 taken about line 3-3.
Figure 5:
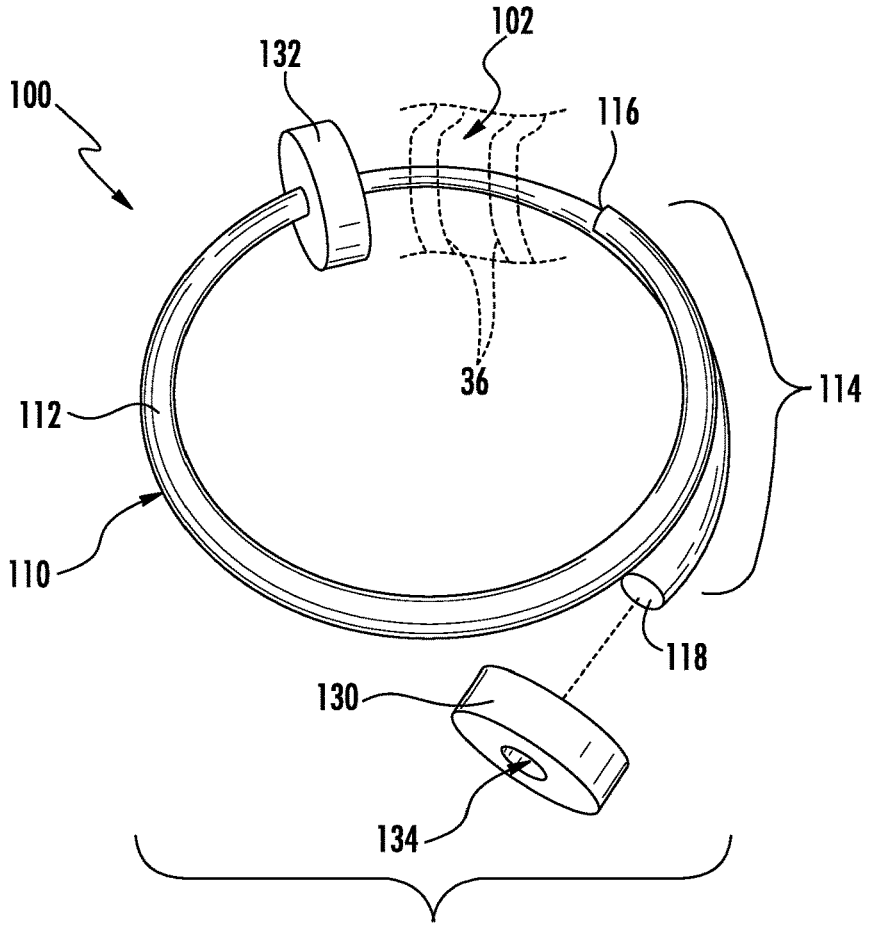
FIG. 5 illustrates a perspective, partially assembled view of the cord retention assembly shown in FIG. 3.

Referring now to FIGS. 3-5, several views of one illustrative embodiment of a cord retention assembly 100 are illustrated in accordance with aspects of the present subject matter. Specifically, FIG. 3 illustrates an enlarged view of one of the cord retention assemblies 100 shown in FIG. 2 and FIG. 4 illustrates a cross-sectional view of a portion of the cord retention assembly 100 shown in FIG. 3 taken about line IV-IV. Additionally, FIG. 5 illustrates a perspective, partially assembled view of the cord retention assembly 100 shown in FIG. 3. It should be appreciated that, for purposes of description, the cord retention assembly 100 shown in FIGS. 3-5 will generally be described with reference to one of the cord retention assemblies 100 positioned on the shade panel 20 at one of the first attachment locations 102. However, the cord retention assembly 100 shown in FIGS. 3-5 may also correspond to any of the cord retention assemblies 100 positioned on the shade panel 20 at the second attachment locations 104.

As shown in FIGS. 3-5, the cord retention assembly 100 may include a cord guide 110 configured to receive a cord(s) of the covering 100 (e.g., one of the lift cords 40, 42 and/or one or more cords of the associated cord shroud 60, 62). For instance, in the illustrated embodiment, the cord guide 110 is shown as receiving both the first lift cord 40 and one of the primary cords 64 of the first cord shroud 60. However, in other embodiments, the cord guide 110 may be configured to receive any other suitable cord(s) of the covering 100.

In general, the cord guide 110 may correspond to any suitable component that is configured to define a closed shape for receiving one or more of the cords of the covering 100. As such, the cord guide 110 may function to retain the cord(s) relative to the shade panel 20 (e.g., by retaining the lift cord 40 and the associated cord shroud 60 relative to the shade panel 20). In addition, by coupling the disclosed cord guides 110 to the shade panel 20 at fixed intervals, the cord guides 110 may set the vertical spacing associated with the cord shroud(s) 60, 62 for limiting the size of the loop that can be formed by the lift cords 40, 42. Moreover, the cord guides 110 may also facilitate the formation of hobbles when the shade panel 20 is moved to its retracted position.

Additionally, in several embodiments, the cord guide 110 may be configured to include a selectively operable access location or entryway defined along at least a portion of its outer perimeter for inserting or receiving the cord(s) and/or any other component(s) of the covering 100 (e.g., one or more fibers or yarns 36 of the covering 100) within the closed shape formed by the cord guide 110. In general, the entryway of the cord guide 110 may be defined by any suitable structure and/or may have any suitable configuration that allows a component(s) of the covering 100 to be received within the cord guide 110 by passing or inserting the component(s) through the entryway. For instance, as will be described below, in one embodiment, the entryway for the cord guide 110 may be defined or formed by a split overlapped portion of the cord guide 110. Alternatively, in other embodiments, the entryway may be defined or formed by a movable section or portion of the cord guide 110. For example, in one embodiment, a portion of the cord guide 110 may be hinged, pivotable, and/or otherwise movable relative to the remainder of the cord guide 110 at a location defined around the perimeter of the cord guide 110 such that the entryway is formed when such movable portion of the cord guide 110 is moved relative to the remainder of the cord guide 110 (e.g., by configuring the cord guide 110 to include a hinged or movable gate, similar to a carabiner, that can be moved to an opened position relative to the remainder of the cord guide 110 to define the entryway for receiving the component(s) of the covering 100). In such an embodiment, it should be appreciated that the cord guide 110 may define its closed shape when the movable portion of the cord guide 110 is moved to a corresponding closed position relative to the remainder of the cord guide 110 and may selectively define the entryway when the movable portion of the cord guide 100 is moved to a corresponding opened position relative to the remainder of the cord guide 110.

As shown in the illustrated embodiment, the cord guide 110 has a split, overlapped configuration around at least a portion of the perimeter of its closed shape to allow the cord guide 110 to be coupled to one or more fibers or any other components of the shade panel 20 (including any commonly used components for coupling other components to a shade panel) at its corresponding attachment location 102. For example, as shown in FIGS. 3-5, in one embodiment, the cord guide 110 may correspond to a split-ring formed by a wire 112 that has been coiled to define a closed, circular shape. In such an embodiment, the wire 112 may be coiled more than 360 degrees such that the cord guide 100 defines a split-overlapped portion 114. For instance, as shown in FIGS. 3 and 5, the wire 112 may extend between a first end 116 and a second end 118, with the split overlapped portion 114 being defined as the circumferential section of the cord guide 110 along which the wire 112 overlaps itself between the first and second ends 116, 118.

By including the split-overlapped portion 114, the cord guide 110 may be attached to the shade panel 20, for example, by inserting a fiber(s) or other component(s) of the shade panel 20 between the sections of the wire 112 forming the split overlapped portion 114 and threading (or rotating) the cord guide 110 relative to the shade panel 20. For instance, as shown in FIG. 3, the cord guide 110 may be coupled to one or more of the yarns 36 of the shade panel 20 positioned at or extending across the corresponding attachment location 102 for the cord guide 110. In such an embodiment, one of the ends 116, 118 of the cord guide 110 may be inserted behind the yarn(s) 36 such that the yarn(s) 36 is received within the split-overlapped portion 114 of the cord guide 110. The cord guide 110 may then be rotated relative to the yarn(s) 36 to allow the cord guide 110 to be threaded onto the yarn(s) 36. For instance, the cord guide 110 may be rotated until the yarn(s) 36 is passed through the split-overlapped portion 114 and is received within the interior of the cord guide 110, thereby coupling the cord guide 110 to the shade panel 20. Alternatively, the cord guide 110 may be maintained stationary while the yarn(s) 36 is passed through the split-overlapped portion 114 to allow the cord guide 110 to be coupled to the shade panel 20.

It should be appreciated that, in alternative embodiments, the cord guide 110 may have any other suitable configuration that defines a closed shape including a split, overlapped configuration around at least a portion of the perimeter of its closed shape. For instance, as opposed to the circular shape shown in the illustrated embodiment, the wire 112 may be formed into any other suitable closed shape, such as a triangular or rectangular shape, with a portion of the wire 112 overlapping itself along a section of such shape to form the split overlapped portion 114. Additionally, as indicated above, as opposed to the slip overlapped portion 114, the cord guide 110 may include any other suitable structure and/or may have any suitable configuration that allows the cord guide 110 to define a selectively operable entryway for receiving a component(s) of the covering 100 (e.g., one or more of the fibers or yarns 36 of the covering 100)

Additionally, in several embodiments, the cord retention assembly 100 may also include one or more retention members configured to be coupled to the cord guide 110 at or adjacent to its corresponding attachment location 102 to prevent the cord guide 110 from becoming decoupled from the shade panel 20 due to unintended rotation of the cord guide 110. For example, the retention members may be configured to block the entryway of the cord guide 110 from being rotated past the attachment location 102, thereby preventing unintentional decoupling of the cord guide 110 from the shade panel 20. Specifically, in the illustrated embodiment, the retention member(s) may be configured to prevent the split overlapped portion 114 of the cord guide 110 from being rotated past the attachment location 102 in manner that would allow the cord guide 110 to be unthreaded from the yarns 36 or other fibers of the shade panel 20. For instance, as indicated above, with a split-ring configuration, the cord guide 110 may often spin or rotate relative to the shade panel 20, which increases the likelihood of the cord guide 110 unthreading itself from the shade panel 20. However, by coupling the disclosed retention member(s) to each cord guide 110 at or adjacent to each corresponding attachment location 102, 104, such unintentional decoupling of the cord guide 110 from the shade panel 20 may be avoided.

As shown in FIGS. 3-5, in one embodiment, the retention member(s) may correspond to a pair of washers or spacers (e.g., a first spacer 130 and a second spacer 132) installed on the cord guide 110. In such an embodiment, the spacers 130, 132 may be configured to be positioned on the cord guide 110 along opposed sides of the attachment location 102 relative to the entryway for the cord guide 100. For instance, as shown in FIG. 3, the spacers 130, 132 may be positioned on the wire 112 of the cord guide 110 along either side of the yarn(s) 36 used to couple the cord guide 110 to the shade panel 20 such that each spacer 130, 132 is disposed circumferentially between the split overlapped portion 114 and the yarn(s) 36. Specifically, a circumferential section 120 (FIG. 3) of the cord guide 110 may be defined between the spacers 130, 132 across which the yarn(s) 36 is coupled that excludes the split overlapped portion 114 of the cord guide 110.

As particularly shown in FIGS. 4 and 5, each spacer 130, 132 may define an opening 134 configured to receive the wire 112 of the cord guide 110. In such an embodiment, a diameter 136 of the opening 134 may be greater than the diameter 122 of the wire 112 to allow each spacer 130, 132 to be installed onto the cord guide 110. For instance, one of the ends 116, 118 of the wire 112 may be inserted through the opening 134 to allow each spacer 130, 132 to be passed through the split overlapped portion 114 and installed onto the cord guide 110.

Additionally, as particularly shown in FIG. 4, the diameter 136 of the opening 134 may be less than a corresponding axial height 124 of the split overlapped portion 114 (e.g., a length equal to twice the diameter 122 of the wire 112). As such, once the spacers 130, 132 are installed on the cord guide 110 as described above, each spacer 130, 132 may function to prevent the split overlapped portion 114 from being rotated past the attachment location 102 defined between the cord guide 110 and the shade panel 20, thereby preventing the cord guide 110 from unthreading itself from the yarn(s) 36. For instance, as shown in FIG. 3, if the cord guide 110 is rotated in a first direction (e.g., as indicated by arrow 106) relative to the portion of the yarn(s) 36 disposed at the attachment location 102, the split overlapped portion 114 may contact the first spacer 130 (e.g., at the first end 116 of the wire 112), thereby preventing further rotation of the cord guide 110 in the first direction 106. Similarly, if the cord guide 110 is rotated in an opposite, second direction (e.g., as indicated by arrow 108) relative to the portion of the yarn(s) 36 disposed at the attachment location 102, the split overlapped portion 114 may contact the second spacer 132 (e.g., at the second end 118 of the wire 112), thereby preventing further rotation of the cord guide 110 in the second direction 108.

It should be appreciated that, in general, each spacer 130, 132 may have any suitable configuration that allows it to function as described herein. For instance, in the illustrated embodiment, each spacer has a circular, washer-like configuration. However, in other embodiments, the spacers 130, 132 may have any other suitable shape and/or configuration that allows each spacer 130, 132 to be installed onto the cord guide 110 and to function to prevent rotation of the split overlapped portion 114 across the attachment location 102, 104 for the cord guide 110. Additionally, it should be appreciated that the spacers 130, 132 may generally be formed from any suitable material(s). However, in a particular embodiment, it may be desirable to form the spacers 130, 132 from an ultraviolet-stable ("UV-stable") material, such as any suitable UV-stable polymer material (including polymer materials that have been provided with UV stabilizing additives).

It should also be appreciated that the spacers 130, 132 may be installed on the cord guide using any suitable methodology. For instance, as shown in FIG. 5, in one embodiment, one of the spacers (e.g., the second spacer 132) may be initially installed onto the cord guide 110 prior to the cord guide 110 being coupled to the shade panel 20. Thereafter, once the cord guide 110 has been coupled to the shade panel 20, the other spacer (e.g., the first spacer 130) may be installed onto the cord guide 110 such that the spacers 130, 132 are positioned on the cord guide 110 along opposed sides of the attachment location 102 relative to the split overlapped portion 114 of the cord guide 110.

Figure 6:
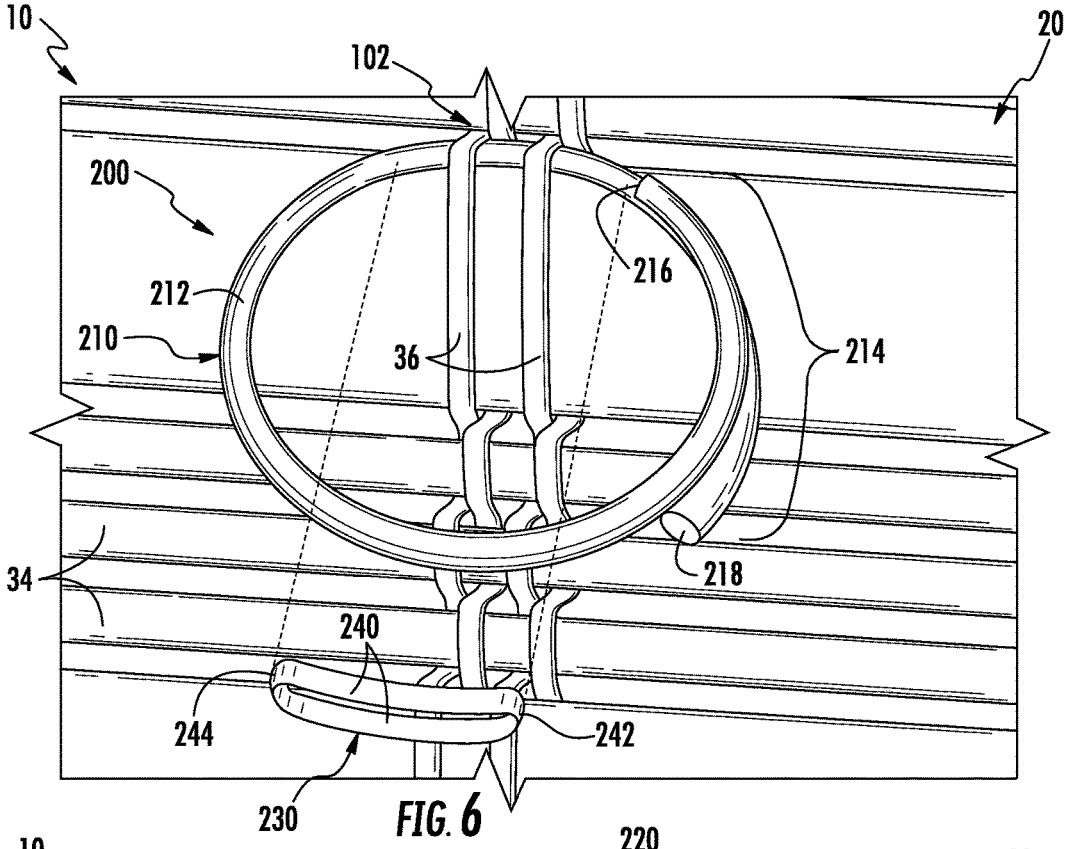
FIG. 6 illustrates a perspective, exploded view of another embodiment of a cord retention assembly in accordance with aspects of the present subject matter, particularly illustrating the cord retention assembly installed relative to a portion of the covering shown in FIG. 2.
Figure 7:
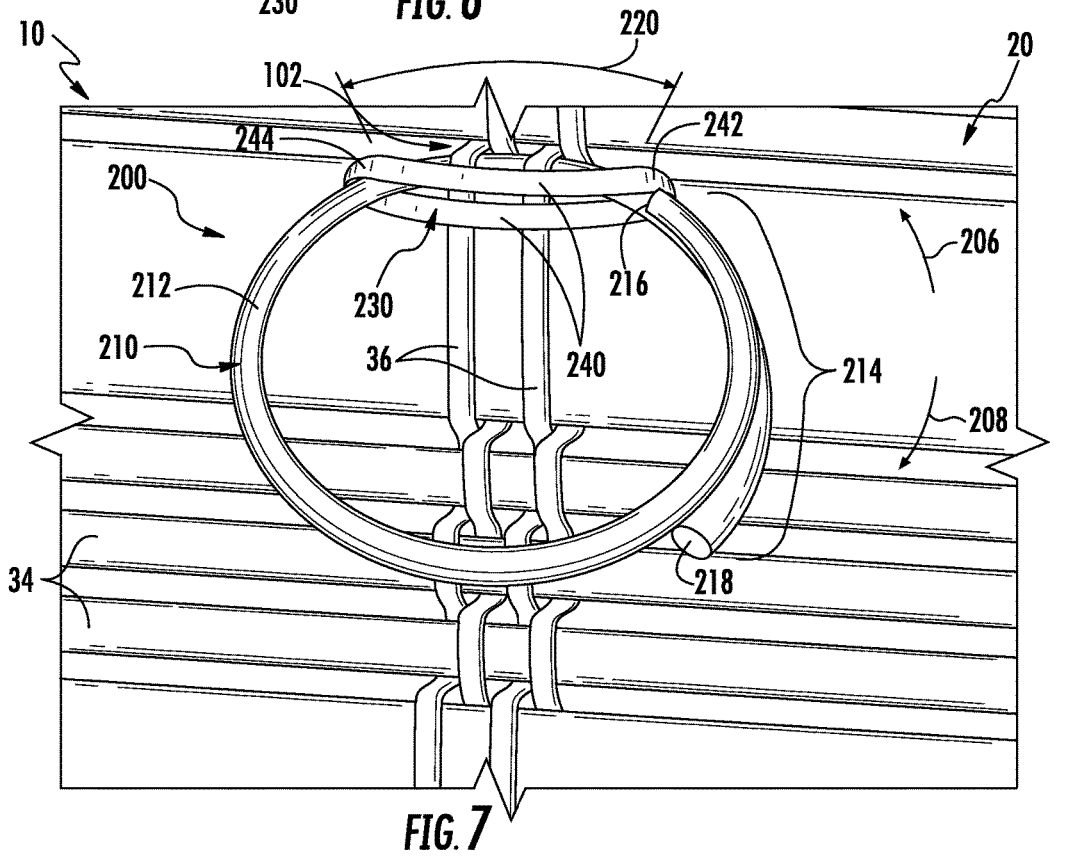
FIG. 7 illustrates a perspective, assembled view of the cord retention assembly shown in FIG. 6.

Referring now to FIGS. 6 and 7, another illustrative embodiment of a cord retention assembly 200 is illustrated in accordance with aspects of the present subject matter. Specifically, FIG. 6 illustrates an exploded, perspective view of the cord retention assembly 200 and FIG. 7 illustrates an assembled, perspective view of the cord retention assembly 200 shown in FIG. 6. It should be appreciated that, for purposes of description, the cord retention assembly 200 shown in FIGS. 6 and 7 will generally be described with reference to one of the cord retention assemblies configured to be positioned on the shade panel 20 at one of the first attachment locations 102. However, the cord retention assembly 200 shown in FIGS. 6 and 7 may also correspond to one of the cord retention assemblies configured to be positioned on the shade panel 20 at any of the second attachment locations 104.

As shown in FIGS. 6 and 7, the cord retention assembly 200 may include a cord guide 210 configured to receive a lift cord 40, 42 and/or one or more cords of the associated cord shroud 60, 62 of the disclosed covering 10. In general, the cord guide 210 may be configured the same as or similar to the cord guide 110 described above. For instance, as shown in FIGS. 6 and 7, the cord guide 210 may correspond to a split-ring formed by a wire 212 that has been coiled to form a closed, circular shape, with the wire 212 overlapping itself between its opposed first and second ends 216, 218 to form a split overlapped portion 214 extending circumferentially around a section of the cord guide 210. However, in other embodiments, the cord guide 210 may have any other suitable configuration consistent with the disclosure provided herein.

Additionally, similar to the embodiment described above with reference to FIGS. 3-5, the cord retention assembly 200 may also include one or more retention members configured to be coupled to the cord guide 210 at or adjacent to its corresponding attachment location 102 to prevent the cord guide 210 from becoming decoupled from the shade panel 20, such as a result of unintended rotation of the cord guide 210. However, as shown in FIGS. 6 and 7, unlike the spacers 130, 132 described above, the retention member corresponds to an elastic, looped band 230 configured to be coupled to the cord guide 210 at or adjacent to the attachment location 102 defined between the shade panel 20 and the cord guide 210. In such an embodiment, the elastic band 230 may be configured to be positioned on the cord guide 210 such that portions of the elastic band 230 extend along opposed sides of the attachment 102 location relative to the split overlapped portion 214 of the cord guide 210. For instance, as shown in FIG. 7, when the elastic band 230 is installed onto the cord guide 210, a central portion 240 of the elastic band 230 may extend across the yarn(s) 36 used to couple the cord guide 210 to the shade panel 20 at the attachment location 102 and first and second side portions 242, 244 of the band 230 may be disposed along the opposed sides of the yarn(s) 36. As a result, each side portion 242, 244 of the elastic band 230 may be disposed circumferentially between the split overlapped portion 214 of the cord guide 210 and the yarn(s) 36. For instance, as shown in FIG. 7, a circumferential section 220 of the cord guide 210 may be defined between the side portions 242, 244 of the elastic band 230 across which the yarn(s) 36 is coupled that excludes the split overlapped portion 214 of the cord guide 210.

By installing the elastic band 230 onto the cord guide 210 as shown in FIG. 7, the elastic band 230 may function to prevent the split overlapped portion 214 of the cord guide 210 from being rotated past the attachment location 102 defined between the cord guide 210 and the shade panel 20, thereby preventing the cord guide 210 from unthreading itself from the yarn(s) 36. For instance, as shown in FIG. 7, if the cord guide 210 is rotated in a first direction (e.g., as indicated by arrow 206) relative to the portion of the yarn(s) 36 disposed at the attachment location 102, the split overlapped portion 214 may contact the first side portion 242 of the elastic band 230 (e.g., at the first end 216 of the wire 212), thereby preventing further rotation of the cord guide 210 in the first direction 206. Similarly, if the cord guide 210 is rotated in an opposed, second direction (e.g., as indicated by arrow 208) relative to the portion of the yarn(s) 36 disposed at the attachment location 102, the split overlapped portion 214 may contact the second side portion 244 of the elastic band 230 (e.g., at the second end 218 of the wire 212), thereby preventing further rotation of the cord guide 210 in the second direction 208.

It should be appreciated that the elastic band 230 may be installed on the cord guide 210 using any suitable methodology. For instance, in one embodiment, the cord guide 210 may be initially installed onto the shade panel 20 at the attachment location 102, such as by passing one or more of the yarns 36 located at the attachment location 102 through the split-overlapped portion 214 of the cord guide 210. Once the cord guide 210 is installed, the elastic band 230 may be stretched to allow it be installed over and onto the cord guide 210 as shown in FIG. 7. Thereafter, the lift cord 40 and/or or more cords of the corresponding cord shroud 60 may be installed relative to the cord guide 210.

It should also be appreciated that the elastic band 230 may be formed from any suitable material(s) that allows it to function as described herein. For instance, the elastic band 230 may be formed from a rubber material or any other suitable elastic or resilient material. In addition, similar to the embodiment described above, it may be desirable for the elastic or resilient material selected for the elastic band 230 to be UV-stable.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A covering for an architectural structure, comprising:

a shade panel extending vertically between a top end and a bottom end and laterally between a first side and a second side, said shade panel defining a front face and a rear face opposite the front face;

a cord extending at least partially between said top and bottom ends of said shade panel along said rear face of said shade panel;

a cord shroud provided in operative association with said cord along at least a portion of said cord between said top and bottom ends of said shade panel;

a cord retention assembly positioned at or adjacent to said rear face of said shade panel, said cord retention assembly comprising:

a cord guide coupled to said shade panel at an attachment location, said cord guide forming a closed shape within which said cord is received, said cord guide being configured to define an entryway around at least a portion of a perimeter of said cord guide; and at least one retention member installed relative to said cord guide at or adjacent to said attachment location;

wherein said at least one retention member is configured to prevent said entryway of said cord guide from being moved past said attachment location in a manner that would allow said cord guide to become decoupled from said shade panel.

2. The covering of claim 1, wherein:

said cord guide is coupled to said shade panel via at least one fiber of said shade panel disposed at said attachment location; and said at least one fiber is passed through said entryway to allow said at least one fiber to be received within said closed shape to couple said cord guide to said shade panel at said attachment location.

3. The covering of claim 2, wherein said at least one retention member is configured to prevent said entryway of said cord guide from being rotated past said attachment location in manner that would allow said cord guide to be unthreaded from said at least one fiber.

4. The covering of claim 2, wherein:

said shade panel corresponds to a woven wood panel; and said at least one fiber corresponds to a yarn of said woven wood panel.

5. The covering of claim 1, wherein said entryway corresponds to a split overlapped portion of said cord guide.

6. The covering of claim 1, wherein said at least one retention member comprises a first spacer and a second spacer installed on said cord guide relative to said attachment location.

7. The covering of claim 6, wherein said first and second spacers are installed on said cord guide along opposed sides of said attachment location relative to said entryway of said cord guide.

8. The covering of claim 7, wherein:

when said cord guide is rotated relative to said shade panel in a first direction, a first portion of said cord guide contacts said first spacer to prevent said entryway from being rotated past said attachment location in said first direction; and when said cord guide is rotated relative to said shade panel in an opposed second direction, a second portion of said cord guide contacts said second spacer to prevent said entryway from being rotated past said attachment location in said second direction.

9. The covering of claim 6, wherein:

said cord guide is formed from a coiled wire that overlaps itself to form a split overlapped portion defining said entryway for said cord guide; and each of said first and second spacers defines an opening configured to receive said coiled wire to allow said first and second spacers to be installed on said cord guide.

10. The covering of claim 9, wherein said opening is dimensionally smaller than a corresponding dimension of said split overlapped portion to prevent said split overlapped portion from being received within said opening.

11. The covering of claim 1, wherein said at least one retention member comprises an elastic band installed on said cord guide relative to said attachment location.

12. The covering of claim 11, wherein said elastic band is installed on said cord guide such that a central portion of said elastic band extends across said attachment location and opposed first and second side portions of said elastic band are positioned along opposed sides of said attachment location.

13. The covering of claim 12, wherein:

when said cord guide is rotated relative to said shade panel in a first direction, a first portion of said cord guide contacts said first side portion of said elastic band to prevent said entryway from being rotated past said attachment location in said first direction; and when said cord guide is rotated relative to said shade panel in an opposed second direction, a second portion of said cord guide contacts said second side portion of said elastic band.

14. The covering of claim 1, wherein said at least one retention member is formed from a UV-stable material.

15. The covering of claim 1, wherein said cord comprises a lift cord of said covering.

16. The covering of claim 1, wherein said at least one retention member is installed on said cord guide directly between said attachment location and said entryway.

17. A covering for an architectural structure, comprising:

a shade panel extending vertically between a top end and a bottom end and laterally between a first side and a second side; said shade panel defining a front face and a rear face opposite the front face;

a cord extending at least partially between said top and bottom ends of said shade panel along said rear face of said shade panel; and a cord retention assembly positioned at or adjacent to said rear face of said shade panel, said cord retention assembly comprising:

a cord guide coupled to said shade panel at an attachment location, said cord guide forming a closed shape and having a split overlapped portion, said cord being received within said closed shape of said cord guide; and first and second retention members installed relative to said cord guide at or adjacent to said attachment location;

wherein said first and second retention members are positioned relative to said cord guide so as to prevent said split overlapped portion of said cord guide from being rotated past said attachment location.

18. The covering of claim 17, wherein:

said cord guide is coupled to said shade panel via at least one fiber of said shade panel disposed at said attachment location; and said at least one fiber is passed through said split overlapped portion to allow said at least one fiber to be received within said closed shape to couple said cord guide to said shade panel at said attachment location.

19. The covering of claim 18, wherein:

said shade panel corresponds to a woven wood panel; and said at least one figure comprises at least one yarn of said woven wood panel.

20. The covering of claim 17, wherein said first and second retention members comprise first and second spacers installed on said cord guide relative to said attachment location.

21. The covering of claim 17, wherein said first and second retention members are installed on said cord guide along opposed sides of said attachment location relative to said split overlapped portion of said cord guide such that said first retention member is positioned between a first side of said attachment location and said split overlapped portion and said second retention member is positioned between a second side of said attachment location and said split overlapped portion.

22. A covering for an architectural structure, said covering comprising:

a shade panel extending between a top end and a bottom end and laterally between a first side and a second side;

a lift cord extending at least partially between said top end and said bottom end of said shade panel and operable to raise or lower said shade panel;

two or more cord retention assemblies installed relative to said shade panel, each cord retention assembly comprising:

a cord guide configured to define at least one entryway through which a component of said shade panel passes to be received within a closed interior of said cord guide; and a retention member installed on each respective said cord guide between said at least one entryway and said component of said shade panel received within said closed interior of said cord guide to block said component of said shade panel from passing through said at least one entryway and allowing said cord guide to decouple from said shade panel.

23. The covering of claim 22, further comprising a cord shroud provided in operative association with said lift cord along at least a portion of said lift cord between said top and bottom ends of said shade panel, said cord shroud corresponding to a different component than said retention member.

24. The covering of claim 22, wherein said retention member comprises a first spacer installed on said cord guide.

25. The covering of claim 24, further comprising a second retention member comprising a second spacer installed on said cord guide, said first and second spacers being installed on said cord guide along opposed sides of said component of said shade panel relative to said at least one entryway of said cord guide.

26. The covering of claim 22, wherein said retention member comprises an elastic band installed on said cord guide.

27. A covering for an architectural structure, comprising:

a shade panel extending vertically between a top end and a bottom end and laterally between a first side and a second side, said shade panel defining a front face and a rear face opposite the front face;

a cord extending at least partially between said top and bottom ends of said shade panel along said rear face of said shade panel; and a cord retention assembly positioned at or adjacent to said rear face of said shade panel, said cord retention assembly comprising:

a cord guide coupled to said shade panel at an attachment location, said cord guide forming a closed shape within which said cord is received, said cord guide being configured to define an entryway around at least a portion of a perimeter of said cord guide; and at least one retention member installed relative to said cord guide at or adjacent to said attachment location;

wherein:

said at least one retention member is configured to prevent said entryway of said cord guide from being moved past said attachment location in a manner that would allow said cord guide to become decoupled from said shade panel; and said at least one retention member comprises an elastic band installed on said cord guide relative to said attachment location.

* * * * *